United States Patent [19]

Naka

[11] Patent Number: 4,566,233

[45] Date of Patent: Jan. 28, 1986

[54] CEILING CONSTRUCTION

[75] Inventor: Hiromitsu Naka, Yashio, Japan

[73] Assignee: Kabushiki Kaisha Naka Gijutsu Kenkyusho, Tokyo, Japan

[21] Appl. No.: 515,263

[22] Filed: Jul. 19, 1983

[30] Foreign Application Priority Data

Jul. 11, 1983 [JP] Japan ..... 57-127260

[51] Int. Cl.[4] ..... E06B 3/00

[52] U.S. Cl. ..... 52/208; 52/204; 292/256.71

[58] Field of Search ..... 52/205, 208, 213, 214, 52/656, 196, 489, 488, 669, 665, 28, 210, 204; 98/40 DL, 40 D; 292/256.71

[56] References Cited

U.S. PATENT DOCUMENTS

| | | | |
|---|---|---|---|
| 386,641 | 7/1888 | Lein | 292/256.71 |
| 2,822,584 | 2/1958 | Urbain | 52/488 |
| 2,913,571 | 11/1959 | Smith | 98/40 DL |
| 3,121,259 | 2/1964 | Versen | 52/28 |
| 3,397,499 | 8/1968 | Ward | 52/665 |
| 3,743,826 | 7/1973 | Halfaker | 98/40 DL |
| 4,103,948 | 8/1978 | Naka | 292/258 X |
| 4,139,972 | 2/1979 | Naka | 52/208 |
| 4,443,973 | 4/1984 | Naka | 49/395 |

FOREIGN PATENT DOCUMENTS

| | | | |
|---|---|---|---|
| 2719296 | 11/1977 | Fed. Rep. of Germany | 52/488 |
| 1352258 | 11/1964 | France | 52/200 |

*Primary Examiner*—John E. Murtagh
*Assistant Examiner*—Kathryn Ford
*Attorney, Agent, or Firm*—Wenderoth, Lind & Ponack

[57] ABSTRACT

A ceiling construction for buildings has a plurality of flanged main beams disposed in a predetermined spaced relationship to each other and bridging between wall mouldings opposed and spaced from each other; a plurality of flanged cross beams connected to the main beams in a predetermined spaced relationship to each other at right angles to the main beams so as to form a ceiling framework; a ceiling wall mounted on the ceiling framework so as to form an access opening in a predetermined position; a pair of auxiliary beams; an access door; and a plurality of hanger devices for the access door. The pair of auxiliary beams each is bridged in a predetermined relationship across the webs of the opposed main beams of the main beams adjacent to and spaced from each other or webs of the opposed cross beams of the cross beams adjacent to and spaced from each other in the access opening. Further, the access door is positioned in the access opening, and is secured to the ceiling framework by the use of the auxiliary beams and hanger devices.

6 Claims, 17 Drawing Figures

CEILING CONSTRUCTION

BACKGROUND OF THE INVENTION

This invention relates to a ceiling construction for buildings and more particularly, to an improved ceiling construction having the ceiling framework which comprises a plurality of main beams and a plurality of cross beams.

Within recent years, ceiling constructions erected by the exposed, concealed and dry wall construction methods have been popularized.

The ceiling framework of the ceiling construction erected by any one of the three known construction methods comprises a grid system which comprises a plurality of flanged main beams and a plurality of flanged cross beams interconnected at right angles to each other to form a grid formation. In the ceiling construction erected by the exposed construction method, the ceiling boards which constitute the ceiling wall are fitted in the grid and laid on the flanges on the main and cross beams in the grid. In the ceiling construction erected by the concealed construction method, the ceiling boards which constitute the ceiling wall are positioned in the grid with the flanges on the main beams received in the grooves formed in the end faces of the ceiling boards. In the ceiling construction erected by the dry wall construction method, the ceiling boards which constitute the ceiling wall are secured to the main and cross beams by means of nails or screws in the grid. The ceiling construction usually includes an access door, but in the ceiling construction erected by the exposed construction method, since the ceiling boards can be easily removed, such a ceiling construction is not provided with the access door. In the ceiling construction erected by the concealed construction method, the ceiling boards are mounted on the main beams by the employment of access angles and hooks in suitable positions on the ceiling whereby the ceiling boards can be removed and thus, as in the case of the ceiling construction erected by the exposed construction method, in the ceiling construction erected by the concealed construction method, the access door is not usually employed. However, when the ceiling boards are designed to be removed, as the ceiling boards are removed and reinstated, the ceiling boards tend to be damaged or smeared leading to undesirable results.

In the ceiling construction erected by the dry wall construction method, since the ceiling boards are not detachable, the access door is disposed in the access opening formed in a suitable position of the ceiling surface. In such a case, taking the weight of the access door into consideration, the access door is attached to the frame channel bound to hanger wires secured to the ceiling slabs by wire fasteners or attached to the frame channel bound to the main beams. In such an access door mounting arrangement, the construction method of the ceiling construction is very troublesome. Especially, when the frame channel is directly hung from the ceiling slabs and the access door is attached to the frame channel, after a prolonged use of the ceiling construction, an undesirable step is formed between the access door and ceiling wall.

SUMMARY OF THE INVENTION

Therefore, one object of the present invention is to provide a ceiling construction for buildings which can be easily erected by the exposed, concealed or dry wall construction method.

Another object of the present invention is to provide a ceiling construction for buildings which is reinforced and is prevented from warping both in the horizontal and vertical directions under the load of the access door as the access door is opened and closed, and which prevents any strain or deflection in the grids of the ceiling construction.

A further object of the present invention is to provide a ceiling construction for buildings which allows the access door to open and close smoothly, which can be easily applied to ceiling walls of different board thicknesses and materials, and in which when the access door is attached to the ceiling framework of the ceiling construction, the access door can be easily aligned with the plane of the ceiling wall in conformity with different thicknesses of boards in the ceiling wall and different assembling arrangements of the ceiling wall to the ceiling construction, and further, which can be easily and simply constructed in a brief period, and which has an improved finish.

For attaining the above objects, the present invention provides a ceiling construction for buildings which comprises:

- a plurality of flanged main beams disposed in a predetermined spaced relationship to each other and bridging between wall mouldings opposed and spaced from each other;
- a plurality of flanged cross beams connected to said main beams in a predetermined spaced relationship to each other at right angles to the main beams so as to form a ceiling framework;
- a ceiling wall mounted on said ceiling framework so as to form an access opening in a predetermined position;
- a pair of auxiliary beams each bridging in a predetermined relationship webs of the opposed main beams of said main beams adjacent to and spaced from each other or webs of the opposed cross beams of said cross beams adjacent to and spaced from each other in said access opening;
- an access door positioned in said access opening and comprising a stationary framework having an outwardly extending flange, a movable framework rotatably connected to said stationary framework and a cover plate fixedly secured to said movable framework; and
- a plurality of hanger means for securing said access door to said ceiling framework through said auxiliary beams so that the access door can be optionally positioned with respect to the plane of a ceiling wall.

The advantages offered by the invention are mainly that various construction methods such as the exposed, concealed and dry wall construction methods can be easily applied, that the ceiling is reinforced and reduced in weight, that even when the weight of the ceiling is reduced the ceiling is prevented from warping in the horizontal and vertical directions under the load of the access door, that any strain or deflection in the grids of the ceiling framework is prevented and that especially, when the access door is suddenly opened and closed, any flapping phenomenon or vibration of the ceiling under the load of the access door is prevented, that the access door can be easily and selectively aligned with the plane of the ceiling in conformity with different thicknesses of boards in the ceiling and different assembling arrangements of the ceiling wall to the ceiling construction, and that the ceiling construction gives an improved finish to the ceiling. Therefore, the ceiling construction for buildings which has the above described arrangement of the components is of practical use.

Thus, since the ceiling construction of the invention is provided with reinforcing means for attaching the access door to the ceiling framework, the ceiling construction of the present invention can be advantageously erected by the exposed, concealed and dry wall construction methods and especially, the ceiling construction of the invention is advantageously and suitably applied to the ceilings of various buildings and especially, to the building ceilings of large dimensions.

BRIEF DESCRIPTION OF THE DRAWINGS

The aforementioned and other objects and attendant advantages of the present invention will be more readily apparent to those skilled in the art from the following description when read in connection with the accompanying drawings, in which.

DETAILED DESCRIPTION OF THE INVENTION

The present invention will be now described referring to the accompanying drawings which show the preferred embodiment of the ceiling construction erected in accordance with the present invention.

Figure 1:
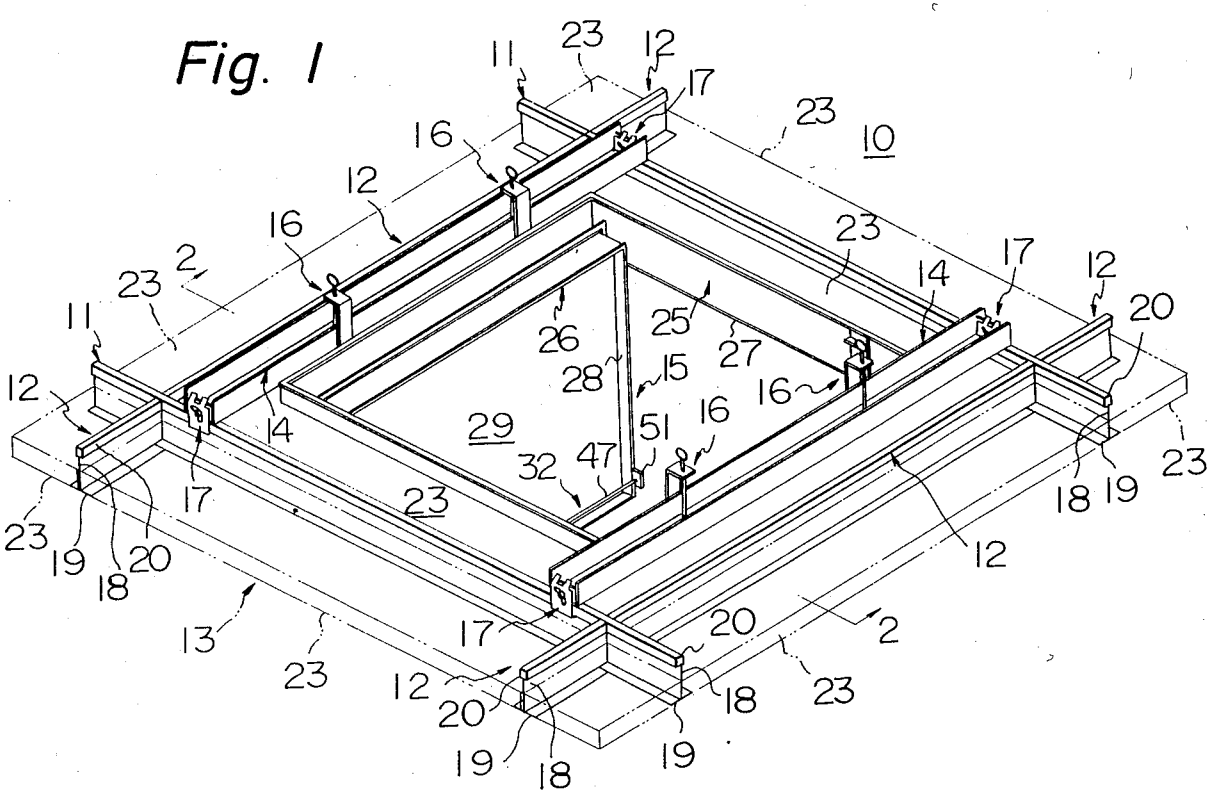
FIG. 1 is a fragmentary perspective view of the preferred embodiment of the ceiling construction erected by the exposed construction method according to the present invention and as applied to a building.
Figure 2:
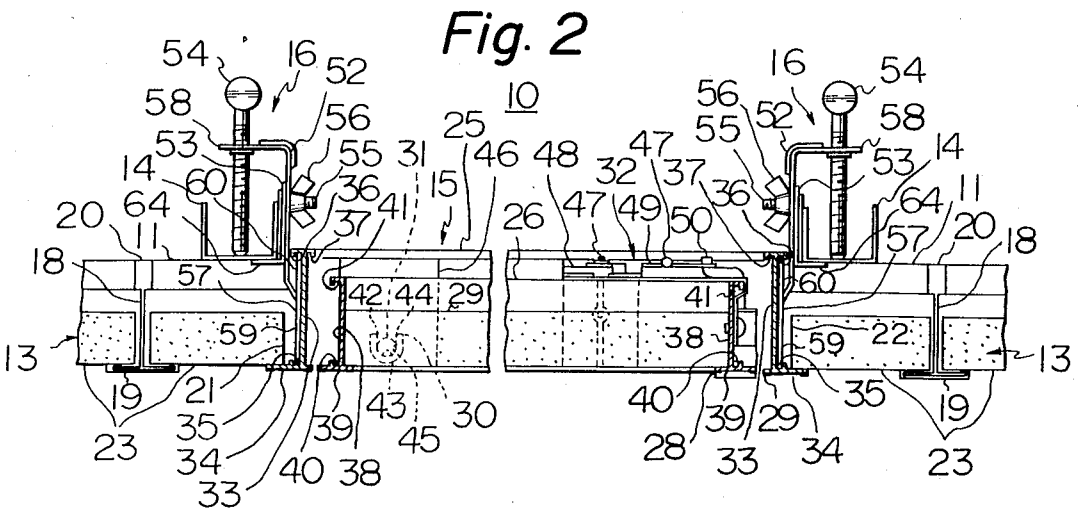
FIG. 2 is a cross-sectional view taken along substantially the line 2—2 of FIG. 1.
Figure 3:
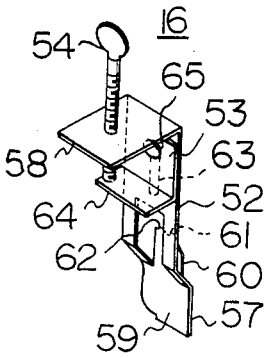
FIG. 3 a perspective view of the hanger means employed in the ceiling construction as shown in FIGS. 1 and 2.

FIGS. 1 to 3 show the preferred embodiment of the ceiling construction of the present invention as applied to a building.

The ceiling construction 10 as shown in FIGS. 1 through 3 is erected by the exposed construction method and includes a plurality of flanged main beams 11 bridging in a predetermined spaced relationship opposed wall mouldings (not shown) attached to the ceiling wall of a room in a building in a square arrangement, said main beams being hung on ceiling slabs by means of hanger wires or hanger rods (not shown) attached to the ceiling slabs in suitably spaced positions, a plurality of flanged cross beams 12 connected in a predetermined spaced relationship to the main beams at right angles to the main beams to form a ceiling framework therewith, a ceiling wall 13 laid on the flanges on the main and cross beams in the ceiling framework to form an access opening 21 in a predetermined position or a selected grid of the ceiling framework, a pair of auxiliary beams 14 secured in a predetermined spaced relationship to a pair of opposing main beams of the plurality of main beams 11 and adjacent the access opening 21, an access door 15 positioned in the access opening 21 and four hanger means 16 for hanging the access door 15 on the auxiliary beams 14 so as to secure the access door 15 to the ceiling framework.

The main beam 11 is formed by rolling metal band such as band steel, aluminum alloy or stainless steel of T-shaped cross section and has end couplings (not shown) at the opposite ends thereof. A number of such main beams 11 are end to end connected to a suitable length in conformity with the dimensions of the ceiling.

Similarly, the cross beam 12 is also formed by rolling metal band such as band steel, aluminum alloy or stainless steel of T-shaped cross section and has a length corresponding to the span between a pair of opposed main beams 11 and between one main beam 11 and the adjacent wall moulding, respectively. The cross beam 12 has twisted clips or hook clips (not shown) at the opposite ends thereof and is adapted to be assembled to the main beam and wall moulding.

The ceiling wall 13 is formed by laying a number of ceiling tiles 23 processed to a predetermined dimension in succession between the flanges 19 on the main and cross beams 11, 12 and between the adjacent and opposed main beam 11 and wall moulding. The type of the ceiling tile 23 is, of course, selected in accordance with the specification of the ceiling wall 13 and the ceiling tile 23 may be replaced by a cement board having heat-resisting fiber mixed therewith, a wooden board or a board having sound absorption material mixed therewith.

Each of the pair of auxiliary beams 14 is formed of I-shaped cross section steel having a length slightly longer than the span between a pair of opposed main beams 11 and bridges the main beams. The auxiliary beam 14 bridges the webs 18 on the opposed main beams 11 or the rectangular bulb 20 on the webs 18 and is secured at the opposite ends to the main beams 11 by means of securing means 17.

The auxiliary beam 14 is provided at the opposite ends thereof with slits 24 for receiving the securing means 17.

The securing means 17 comprises a pair of jaw plates 66, 67 for gripping the rectangular bulb 20 on the associated web 18 of one of the main beams 11 therebetween and a wing screw 68 for tightening the pair of jaw plates 66, 67 together. One of the pair of the jaw plates 66, 67 extends through the slit 24 at the adjacent end of the associated auxiliary beam 14 and along the rectangular bulb 20 on the associated main beam 11 and has a threaded hole (not shown) for threaded engagement with the wing screw 68. The other of the pair of jaw plates 66, 67 also has a hole (not shown) for receiving the wing screw 18.

In this way, the auxiliary beam 14 is firmly secured at the opposite ends thereof to the opposed main beams 11 by means of the securing means 17 to prevent the main beams 11 from moving away from each other in the direction to expand the span between the main beams.

The auxiliary beam 14 can be also, of course, formed by rolling band steel.

The access door 15 is fitted in the access opening 21 and comprises a stationary framework 25 hung on the ceiling framework by hanger means 16 assisted by the auxiliary beams 14, a movable framework 26 disposed within the opening 27 defined by the stationary framework 25 and secured to the stationary framework for movement relative to the stationary framework, a cover plate 28 fixedly secured to the movable framework 26 by means of suitable means to normally close the opening 28 defined by the movable framework 26, a pair of bearings 30 projecting towards each other from the opposed inner side surfaces of the stationary framework 26, a pair of shafts 31 journalled in the bearings 30 and projecting outwardly from the opposed outer side surfaces of the movable framework 26 and a cremorne lock 32. With the afore-mentioned construction and arrangement of the components of the access door 15, when the movable framework and cover plate assembly 26, 29 and more particularly, the cover plate 29 is in the closed position, the stationary framework 25 is locked by the cremorne lock 32 and when the cremorne lock 32 is unlocked the movable framework and cover plate assembly 26, 29 is allowed to rotate downwardly to the open position by the assistance of the bearings 30 and shafts 31.

The stationary framework 25 is formed of four identical extruded aluminum alloy frame members having a predetermined length and arranged in a square shape. More particularly, each of the frame members includes a web 33 and an outwardly extending flange 34 integrally formed with the lower end of the web 33. The frame member further includes a lower groove 35 at the lower end and upper grooves 36, 37 at the upper end, respectively. The stationary framework 25 is, of course, completed by four identical steel corner pieces positioned at the junctures of the four frame members which each has the web, the integral flange and the upper grooves formed on the opposite sides of the web at the upper end and the lower groove at the lower end on one side of the web.

Similarly, the movable framework 26 is formed of four identical extruded aluminum alloy frame members having a predetermined length and arranged in a square shape. More particularly, each of the frame members includes a web 38 and an outwardly extending flange 39 integrally formed with the lower end of the web. Lower and upper grooves 40, 41 are formed at the lower end and upper end of the frame member, respectively. The movable framework 26 also includes four identical steel corner pieces positioned at the junctures between the frame members.

The cover plate 29 comprises some of the ceiling tiles 23 and lies on the outwardly extending flanges 39 on the frame members of the movable framework 26 so as to normally close the opening 28 defined by the movable framework 26. The cover plate 29 is fixedly secured to the movable framework 26 by means of a plurality of securing members and screws.

Each of the pair of bearings 30 includes a bearing groove 42 with a U-shaped bearing face 43 and a pair of bulges 45 on the bearing face 43 in the upper opening 44 extending inwardly from the opposed inner surfaces of the upper opening by a small distance.

By the provision of the inward bulges 45 on the bearing face 43 of the bearing 30, the upper opening 44 of the bearing groove 42 is constricted so that the associated shaft 31 is snapped into and out of the bearing 30.

The bearing 30 has a plate-like bracket 46 integrally formed at one end thereof for easy attachment to the stationary framework 25 whereas the other end of the bearing is positioned adjacent to the adjacent frame member web 38 of the movable framework 26. And a lower portion of the bearing 30 serves as a stopper for the outwardly extending flange 39 on the adjacent frame member of the movable framework 26. The end face of the above-mentioned other end of the bearing 30 engages the movable framework 26 to prevent the movable framework from rocking.

The bearing 30 is integrally formed of polyamide or fluorinated resin together with the bracket 46, but may be formed of bearing alloy.

Each of the pair of shafts 31 has a sleeve of reduced outer diameter at one end and the sleeve extends through a hole formed in the associated corner piece associated with the movable framework 26. The leading end of the sleeve is caulked against the corner piece to be secured thereto.

Thus, when the movable framework 26 is formed by the frame members and corner pieces including the corner pieces against which the shafts 31 are not caulked, the shafts 31 are incorporated into the movable framework 26.

The cremorne lock 32 is disposed on the movable framework 26 and comprises a pair of locking rods 47 having the leading ends guided in guides 51 for projecting from the stationary framework 25 to the movable framework 26 and vice versa, a pair of rod bearings 48 disposed on the stationary framework 25 for receiving the leading ends of the locking rods 47, an operation plate 49 rotatably held on the cover plate 29 and connected to the locking rods 47 and a crank shaft 50 for rotating the operation plate 49 from outside of the cover plate 29. The cremorne lock is conventional.

And the cremorne lock 32 may be replaced by any other conventional locking device.

The hanger means 16 includes a carrier plate 52 for hanging the stationary framework 25 on the associated auxiliary beam 14, a clamping plate 53 for securing the carrier plate 52 to the auxiliary beam 14, a threaded clamping bar 54 for securing the carrier plate 52 to the associated auxiliary beam 14 in cooperation with the clamping plate 53 and a headed screw and wing nut arrangement 55, 56 for securing the clamping plate 53 to the carrier plate 52.

Figure 4:
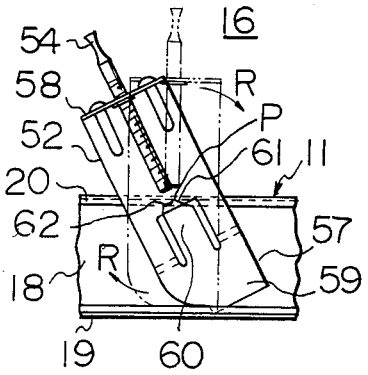
FIG. 4 is a perspective view showing the manner in which the hanger means as shown in FIG. 3 is attached to the access door in the ceiling construction as shown in FIGS. 1 and 2.
Figure 5:
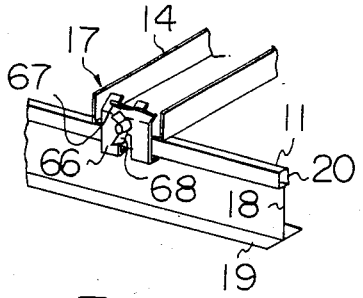
FIG. 5 is a perspective view of the securing means employed in the ceiling construction as shown in FIGS. 1 and 2.
Figure 6:
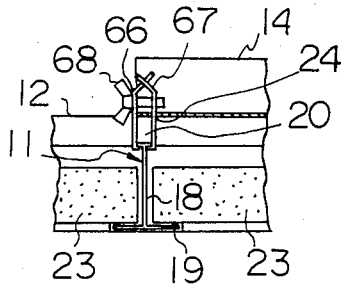
FIG. 6 is a side elevational view of the securing means as shown in FIG. 5.

The carrier plate 52 is provided at the lower end with a plate-like hook 57 adapted to be received into the grooves 35, 36 when the carrier plate is rotated in the direction of R and at the upper end, as shown in FIG. 4, and with a bent arm 58. The hook 57 comprises a stepped portion 59 and a tongue 60 formed by cutting and bending a portion of the carrier plate 52. The carrier plate has a length corresponding to the distance between the grooves 35, 36 and a width slightly smaller than the distance between the ribs having the grooves 35, 36. The carrier plate 52 and tongue 60 are rounded at the upper and lower corners lying in one diagonal line and the tongue 60 has opposing and spaced teeth 61, 62 at the upper end. When the hook 57 is fitted in the grooves 35, 36 by rotating the hook, the hook rotates about the teeth 61, 62 which provide the center of rotation P and when the hook 57 has been fitted in the grooves 35, 36, the teeth 61, 62 are caused to bite into the grooves 35, 36 whereby the carrier plate 52 is firmly secured to the stationary framework 25.

The carrier plate 52 further has a threaded hole (not shown) in the arm 58 thereof for threaded engagement with the associated threaded clamping bar 54. Furthermore, the carrier plate 52 has an elongated slot 63 extending in the longitudinal direction for receiving the associated headed screw 55.

The clamping plate 53 is adapted to be employed in contact with the carrier plate 52 and has at the lower end an arm 64 bent to support the undersurface of the associated auxiliary beam 14. Furthermore, the clamping plate 53 has a hole 65 in which the headed screw 55 extending through the slot 63 in the carrier plate 52 is secured.

Thus, since the hanger means 16 described hereinabove allows the position of the access door 15 being hung on the auxiliary beams 14 to be varied by means of the threaded clamping bar 54, the level of the access door 15 can be easily aligned with the plane of the ceiling and can be connected to the ceiling framework in a plane different from the plane of the ceiling.

Now, the ceiling construction 10 having the components as described hereinabove will be explained. First of all, wall mouldings are attached to the concrete ceiling wall of a building room in accordance with a predetermined layout by the use of concrete nails, a plurality of wire fasteners are driven in a suitably spaced relationship into the ceiling slabs of the room and hanger wires are hung on the wire fasteners.

Thereafter, a plurality of main beams 11 each comprising a number of main beam parts end to end connected to a predetermined length are bridged in a predetermined spaced relationship between opposed wall mouldings in one plane, the main beams 11 are bound to the hanger wires and secured at the opposite ends thereof to the wall mouldings.

Thereafter, a plurality of cross beams 12 are bridged in a predetermined spaced relationship between the opposed main beams and between the associated main beams and wall mouldings, respectively, at right angles to the main beams, the cross beams 12 are connected to the main beams by the twisted clips and to the wall mouldings by the screws, respectively, to thereby form a ceiling construction in cooperation with the wall mouldings and main beams.

After the ceiling framework has been formed by the wall mouldings, main beams 11 and cross beams 12, a plurality of ceiling tiles 23 are in succession laid between the flanges 19 on the main beams 11 between the main and cross beams 11, 12 and between the flanges 19 on the cross beams 12 and wall mouldings, respectively, to thereby form a ceiling wall 13 so as to form an access opening 21 in a selected grid in the ceiling wall 13.

Thereafter, a pair of spaced auxiliary beams 14 having the securing means 17 temporarily attached to the opposite ends are bridged between the webs 18 of the frame members of opposed main beams 11 in the access opening 21, a pair of jaw plates 66, 67 grip the rectangular head 20 on the associated main beam 11, the wing screw 68 is tightened to secure the associated auxiliary beams 14 at the opposite ends to the main beam 11 by the securing means 17, 17 whereby the auxiliary beams 14 are secured to the ceiling framework.

After the auxiliary beams 14 have been secured to the ceiling framework by the securing means 17 in the manner mentioned hereinabove, while the access door 15 and more particularly, the stationary framework 25 having the movable framework 26 removed therefrom and having the four hanger means 16 attached in predetermined positions along the stationary framework is being fitted in the access opening 21, the threaded clamping bars 54 are placed on the auxiliary beams 14.

Thereafter, the threaded clamping bars 54 are turned to hoist the stationary framework 25 into the access opening 21 until the outwardly extending flanges 34 come into contact with the access opening defining edge 22 on the surface of the ceiling wall 13.

When the stationary framework 25 has reached the level of the ceiling wall 13, the wing nuts 56 are loosened and the arms 58 are caused to slide along the carrier plates 52 until the arms 58 come to contact with the auxiliary beams 14, the clamping plates 53 are pulled up and the wing nuts 56 are again tightened to secure the hanger means 16 to the auxiliary beams 14.

As a result, the stationary framework 25 is secured to the ceiling framework.

Thereafter, while the movable framework 26 having the cover plate 29 previously attached thereto is being inserted into the opening 27 defined by the stationary framework 25, the shafts 31 are snapped into the bearings 30 to assemble the movable framework 26 to the stationary framework 26. Thereafter, the movable framework 26 is rotated upwardly to close the opening 27 defined by the stationary framework 25. With the opening 27 in its closed condition, the movable framework 26 and more particularly, the cover plate 29 is locked to the stationary framework 25.

The ceiling construction 10 is erected in the manner as described hereinabove, but the ceiling construction can be erected in various different manners other than the afore-mentioned construction method depending upon the conditions of the room and, the conditions at the job site.

Figure 7:
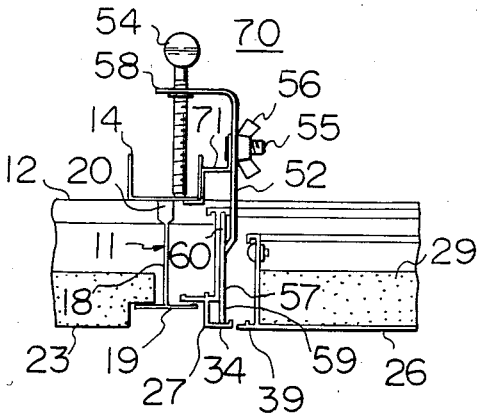
FIG. 7 is a side elevational view of a modified hanger means.
Figure 8:
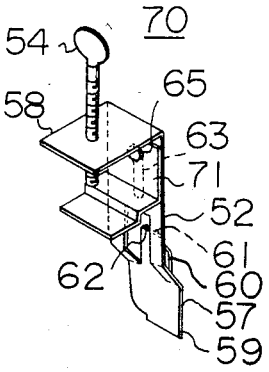
FIG. 8 is a perspective view of the hanger means as shown in FIG. 7.

FIGS. 7 through 13 show modified embodiments of the hanger means which can be employed in the ceiling construction 10 of the present invention. The modified hanger means 70 shown in FIGS. 7 and 8 is applicable to the ceiling construction erected by the concealed construction method. The hanger means 70 is substantially similar to the hanger means 16 except that the stepped clamping plate 71 replaces the clamping plate 53 in the foregoing hanger means 16 whereby the access door 15 is prevented from moving in the horizontal as well as in the upward and downward directions.

Figure 9:
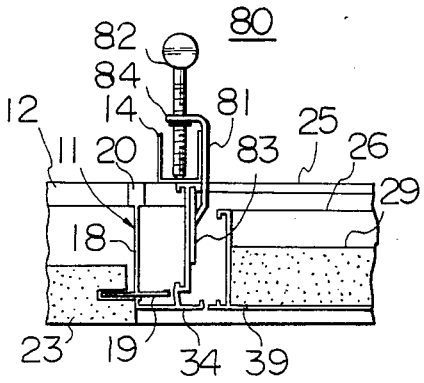
FIGS. 9 and 10 are side elevational views of further modified hanger means.

The modified hanger means 80 shown in FIG. 9 is applicable to the ceiling construction erected by the concealed construction method and comprises a clamping plate 81 and a threaded clamping bar 82. The carrier plate 81 extends in contact with the inner side of the web 33 of the adjacent frame member of the stationary framework 25 and is fitted in the groove 37 in the frame member. The carrier plate 81 is provided at the lower end with a plate-like hook 83 and at the upper end with a bent arm 84, respectively. The arm 84 is provided with a threaded hole (not shown) for threaded engagement with the threaded clamping bar 82. The carrier plate 81 and threaded clamping bar 82 are previously assembled together.

Figure 10:
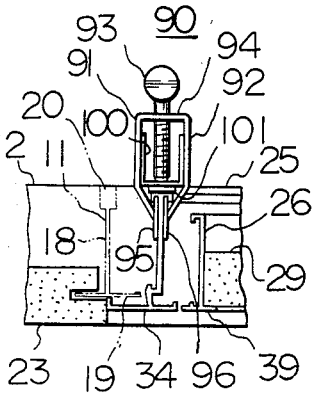
Figure 11:
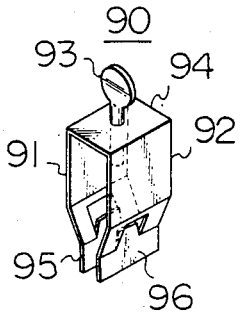
FIG. 11 is a perspective view of the hanger means as shown in FIG. 10.
Figure 12:
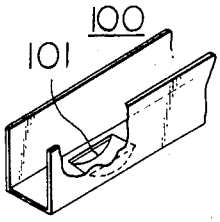
FIG. 12 is a fragmentary perspective view of a modified auxiliary beam.

The modified hanger means 90 shown in FIGS. 10 and 11 is applicable to the ceiling construction erected by the concealed construction method and is a modification of the hanger means 80 shown in FIG. 9.

The hanger means 90 comprises a pair of carrier plates 91, 92 disposed on the opposite sides of the web 33 on the adjacent frame member of the stationary framework 25 and a threaded clamping bar 92.

The carrier plates 91, 92 are connected together at the upper ends by a horizontal connector arm 94 and extend along the opposite sides of the web 33 of the adjacent frame member of the stationary framework 25 in contact therewith to be received in the grooves 36, 37. The carrier plates 91, 92 are provided at the lower end with plate-like hooks 95, 96, respectively. The connector arm 94 is provided with a threaded hole (not shown) for threaded engagement with the associated threaded clamping bar 93.

The hooks 95, 96 of the carrier plates 91, 92 each comprises a bent end and a projecting tongue.

The hanger means 90 is preferably employed in conjunction with a modified auxiliary beam 100. More particularly, the auxiliary beam 100 has a punched out bridge 101 extending downwardly from the undersurface where the auxiliary beam 100 is secured to the associated main beam 11 by the hanger means 90. The bridge 101 accelerates temporary attachment of the auxiliary beam 100 to the stationary framework 25 by the hanger means 90. The bridge 101 also serves as a spring washer for the threaded clamping bar 93.

Figure 13:
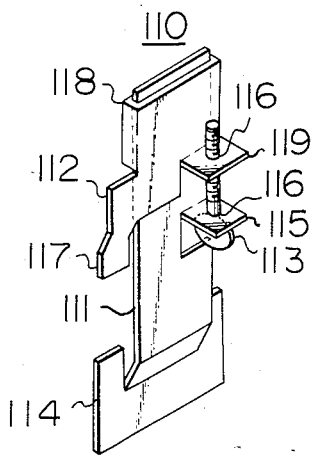
FIG. 13 is a perspective view of a further modified hanger means.

The modified hanger means 110 shown in FIG. 13 comprises a carrier plate 111, a hanger plate 112 for hooking the carrier plate 111 on the auxiliary beam 14 and a threaded clamping bar 113 for connecting the carrier plate 111 and hanger plate 112 together.

The carrier plate 111 extends along the inner side of the web 33 of the adjacent frame member of the stationary framework 25 in contact therewith and is received in the groove 37 in the stationary framework 25. The carrier plate 111 includes a plate-like hook 114 at the lower end for hooking on the stationary framework 25 and in an upper portion a tongue 115 formed by cutting and bending a portion of the carrier plate.

Furthermore, the hanger plate 112 includes at the lower end a hanger tongue 117 for pressing the adjacent flange on the auxiliary beam 14 against the carrier and a sleeve 118 fitted on the upper end portion of the carrier plate 111. An arm 119 is formed by cutting and bending a portion of the carrier plate 112 at an intermediate portion between the lower end upper ends thereof in opposition to and spaced from the tongue 115 on the carrier plate 111. The arm 119 is also, of course, provided with a threaded hole for threaded engagement with the threaded clamping bar 113.

The hanger means 110 having the construction and arrangement of the components as described hereinabove prevents the access door 15 from moving under external force in the vertical and horizontal directions.

Figure 14:
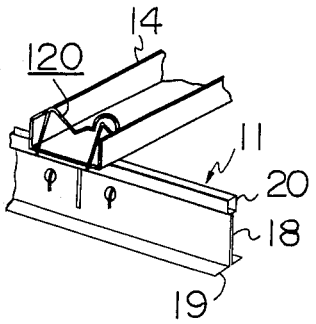
FIGS. 14 through 16 are perspective views of modified securing means.
Figure 15:
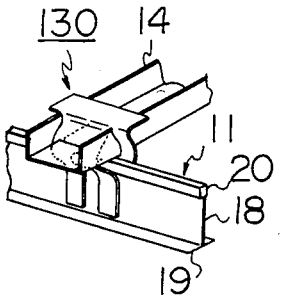

FIGS. 14 through 17 show modified embodiments of the securing means to be employed in the ceiling construction 10 as shown in FIGS. 1 through 6. The modified securing means 120 shown in FIG. 14 is formed by bending a length of piano wire into a clip shape and the modified securing means 130 is formed by bending a length of spring steel plate into a clip shape.

Figure 16:
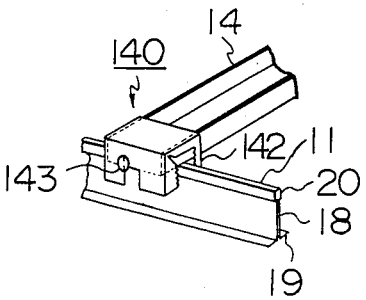
Figure 17:
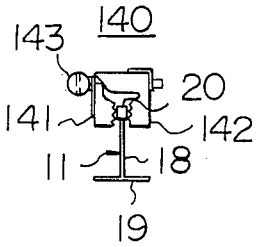
FIG. 17 is a side elevational view of the securing means as shown in FIG. 16.

The modified securing means 140 shown in FIGS. 16 and 17 comprises a pair of jaws 141, 142 and a pair of clamping screws 143 for fastening the jaws together. The pair of jaws 141, 142 are adapted to be bent towards each other so as to grip the rectangular head 20 on the associated main beam 11 as well as the associated auxiliary beam 14 at the adjacent one of the auxiliary beams bridging the opposed main beam 11.

From the foregoing description of the present invention, as compared with the previously proposed and existing prior art ceiling constructions for buildings, it will be understood that in the ceiling construction for buildings according to the present invention, since the ceiling framework comprises a plurality of main beams bridging the wall mouldings and hung on a plurality of hanger wires or hanger rods and a plurality of cross beams bridging the opposed main beams at right angles to the main beams, the ceiling wall is assembled to the ceiling framework and has an access opening in a predetermined position, a pair of spaced auxiliary beams are secured to the webs on a pair of opposed ones of the main beams adjacent to and spaced from the associated cross beams, respectively, in the access opening on the inner side of the ceiling wall and the access door is suspended from the auxiliary beams by means of a plurality of hanger means and secured to the ceiling framework in the access opening, the present invention can be advantageously applied to various ceiling constructions to be constructed by the exposed, concealed and dry wall construction methods, the ceiling construction is reinforced, as the access door is opened and closed, the ceiling structure is prevented from warping under the load of the access door in the horizontal and vertical directions, any strain is prevented from occurring in the ceiling structure, the ceiling structure can be easily applied to ceiling walls of different thickness and materials, when the access door is attached to the ceiling construction, the access door can be easily and selectively aligned with the plane of the ceiling in conformity with the ceiling walls of different thicknesses and different assembling arrangements of the ceiling wall to the ceiling framework and the entire ceiling construction can be easily and simply erected in a brief period and gives an improved finish to the ceiling.

As is clear from the foregoing description of preferred embodiments of the invention referring to the accompanying drawings, it is to be understood that various modifications and changes will easily occur to those having an ordinary knowledge in the art and the invention can be easily replaced by embodiments which satisfy substantially the same objects as those described hereinabove and attain substantially the same effects as those described hereinabove.

What is claimed is:

1. A ceiling construction for buildings, comprising:

a plurality of flanged main beams disposed in a predetermined spaced relationship to each other and positioned for bridging wall moldings opposed and spaced from each other;

a plurality of flanged cross beams connected to said main beams in a predetermined spaced relationship to each other are right angles to the main beams so as to form a ceiling framework;

a ceiling wall mounted in said ceiling framework and having an access opening in a predetermined position;

a pair of auxiliary beams each positioned on the upper side of the ceiling wall and each bridging the flanges of one of a pair of opposed main beams adjacent to and spaced from each other and a pair of opposed cross beams adjacent to and spaced from each other, said auxiliary beams extending along the edges of said access opening;

an access door means positioned in said access opening and having a stationary frame having an outwardly extending flange, a movable frame hingedly connected to said stationary frame, and a cover plate fixedly secured to said movable frame; and a plurality of hanger means securing said access door to said auxillary beams, said hanger means including a carrier plate mountable on said stationary framework for supporting said stationary framework from said hanger means, a clamping plate adjustably mounted in said carrier plate, a threaded fastening means for securing the clamping plate to the carrier plate in an adjusted position thereon, and a threaded clamping bar threaded through said clamping plate and cooperating with said clamping plate for securing the carrier plate to the auxiliary beam.

2. A ceiling construction as claimed in claim 1 in which said clamping plate has a bent arm for engagement with said auxiliary beam, and said clamping bar being opposed to said bent arm against said auxiliary beam with the auxiliary beam between said clamping bar and said bent arm.

3. A ceiling construction as claimed in claim 2 in which said bent arm is flat and engages with the bottom of said auxiliary beam.

4. A ceiling construction as claimed in claim 2 in which said bent arm is stepped and engages with the bottom and side of said auxiliary beam.

5. A ceiling construction as claimed in claim 1 in which said stationary frame has grooves along the upper and lower edges, and said carrier plate has at the lower end a plate-like hook received in said upper and lower grooves.

6. A ceiling construction as claimed in claim 5 in which said hook has a stepped portion and a tongue received in the lower and upper grooves, respectively.

* * * * *